United States Patent [19]

Sasaki et al.

[11] 4,224,685

[45] Sep. 23, 1980

[54] POWER LEVEL SETTING/DISPLAY CIRCUIT FOR A MICROWAVE OVEN

[75] Inventors: Masayuki Sasaki, Kawasaki; Yoshio Oida, Funabashi; Hidetoshi Semi, Kamakura, all of Japan

[73] Assignee: Tokyo Shibaura Denki Kabushiki Kaisha, Japan

[21] Appl. No.: 929,010

[22] Filed: Jul. 28, 1978

[30] Foreign Application Priority Data

Jul. 30, 1977 [JP] Japan ..... 52/91622

[51] Int. Cl.[2] ..... H05B 9/06

[52] U.S. Cl. ..... 364/900; 364/483

[58] Field of Search ..... 364/900, 483, 565, 567; 219/10.55 B

[56] References Cited

U.S. PATENT DOCUMENTS

| | | | |
|---|---|---|---|
| 3,819,906 | 6/1974 | Gould, Jr. | 219/506 |
| 3,931,508 | 1/1976 | Kelch | 364/467 |
| 3,946,219 | 3/1976 | Lucas | 364/465 X |
| 4,011,428 | 3/1977 | Fosnough et al. | 219/10.55 B |
| 4,041,288 | 8/1977 | Conway | 364/483 |
| 4,041,291 | 8/1977 | Pavda | 364/467 X |
| 4,043,193 | 7/1977 | Jackson | 364/465 |
| 4,053,749 | 10/1977 | Shinoda et al. | 364/467 X |
| 4,080,568 | 3/1978 | Funk | 364/483 X |
| 4,081,663 | 3/1978 | Ahlberg | 364/467 |
| 4,158,759 | 6/1979 | Mason | 219/10.55 B |

*Primary Examiner*—Edward J. Wise

*Attorney, Agent, or Firm*—Finnegan, Henderson, Farabow, Garrett & Dunner

[57] ABSTRACT

Disclosed is a power level setting/display circuit for a microwave oven which comprises a logical gate circuit for feeding a maximum power level signal to a setting register by means of a function key for power level setting, a logical gate circuit for supplying the fed maximum power level signal to a display register, a logical gate circuit for storing a power level command signal in a temporary storage register, a logical gate circuit for clearing the contents of the display register simultaneously with such storage of the power level command signal, a logical gate circuit forming a series closed loop by means of the display register and temporary storage register, whereby the power level command signal stored in the temporary storage register will be shifted to the bottom digit of the display register, and a logical gate circuit for supplying the power level command signal stored in the display register to the setting register.

4 Claims, 17 Drawing Figures

POWER LEVEL SETTING/DISPLAY CIRCUIT FOR A MICROWAVE OVEN

BACKGROUND OF THE INVENTION

This invention relates to a power level setting/display circuit for setting and displaying the level of heating power of, for example, a microwave oven, more specifically to a power level setting/display circuit capable of displaying a set value of power level on a display unit in good conditions.

In a microwave oven with a digital display unit, the set heating time, selected temperature, and the power level are displayed on the display unit. The display register is of 4-digit configuration, and the power level is given by the first two digits (e.g., 0 to 99 max.), so that only the last two digits of the display register may be set for use when a function key for power level setting is operated. In changing a power level command "12" into "35," for example, the contents of the last two digits of the display register may be turned into "35" by successively depressing register keys "3" and "5." In changing a power level command "12" into "5," however, the higher-place digit "1" is erased and "5" is placed as the bottom digit by depressing the register key "5" as it is, leaving the figure "2," which has previously been in the bottom place, in the second lowest place. In such case, therefore, power level setting must be executed anew after clearing all the contents of the display register by depressing a clear key or turning the power off and then on, according to the prior art system.

SUMMARY OF THE INVENTION

Accordingly, the object of this invention is to provide a power level setting/display circuit capable of automatically clearing the current data in a display register when setting the power level after operating a function key for power level setting, thereby lightening a burden to users.

According to this invention, there may be obtained a power level setting/display circuit for a microwave oven which comprises a register for temporarily storing a power level command signal, a means for clearing all the contents of a display register when the power level command signal is stored in the temporary storage register, a means for transferring the content of the temporary storage register to a predetermined location of the cleared display register, and a setting register to store the transferred content further fed thereto.

DETAILED DESCRIPTION OF THE PREFERRED EMBODIMENTS

Figure 1:
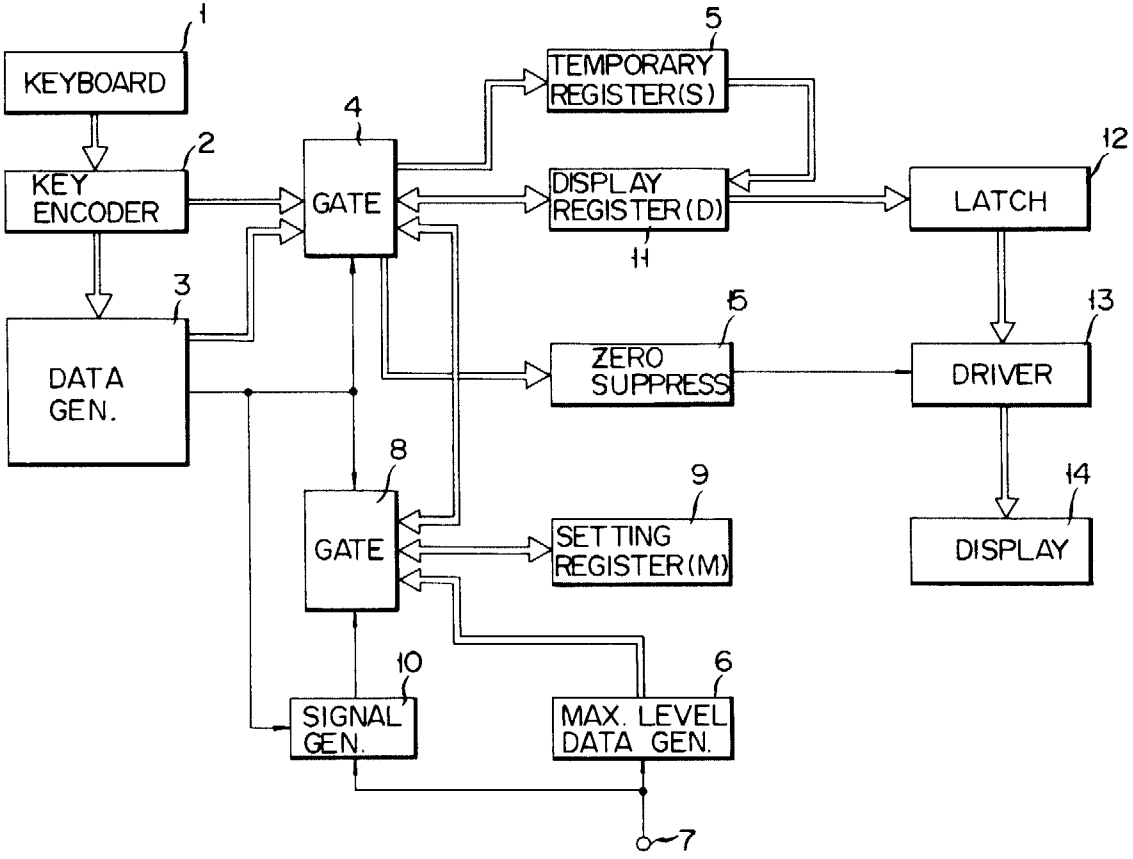
FIG. 1 is a block diagram showing an embodiment of this invention.

Now there will be described an embodiment of the power level setting/display circuit of this invention with reference to the accompanying drawings. In FIG. 1, numeral 1 denotes a ten-key board for setting an optional power level in one of two series, e.g., "0" to "9" and "0" to "99." The output signal of the ten-key board is converted into a code data such as a BCD code by means of a key encoder 2, and into an address data for designating an address in a fixed section of an instruction data generator 3 formed of an ROM, for example. The instruction data generating portion 3 stores a series of instruction data in advance, and successively produces instruction data in addresses corresponding to the address data from the key encoder 2.

Figure 7:
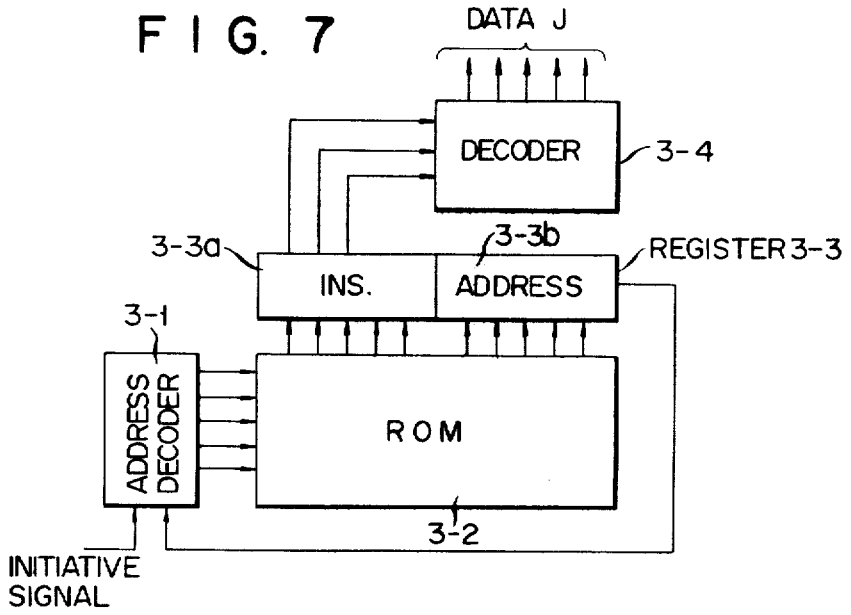
FIG. 7 is a block diagram showing an example of the instruction data generating portion as shown in FIG. 1.
Figure 8:
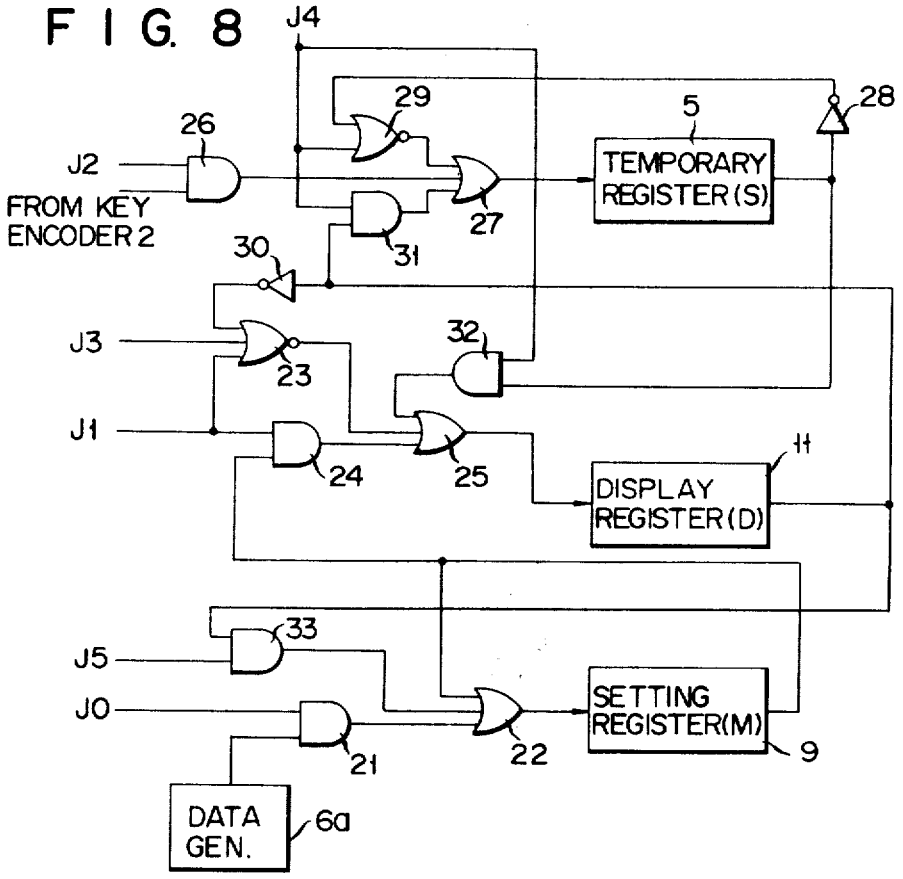
FIG. 8 is a block diagram showing the configuration of the logical gate circuits in the principal part of FIG. 1.

The instruction data generating portion 3 may be constructed as shown in FIG. 7, for example. When an initiative signal is supplied from the key encoder 2 to an address decoder 3-1 by operating a function key for power level setting, a first address designation signal A0 is supplied from the address decoder 3-1 to a ROM 3-2, and a data stored in an address A0 of the ROM 3-2 is transferred to a register 3-3. The register 3-3 is composed of an instruction part 3-3*a* and an address part 3-3*b*. An instruction signal from the ROM 3-2, which appears at the instruction part 3-3*a*, is decoded by a decoder 3-4, whereby a data J0 corresponding to the address A0 is obtained. A next address data A1 is stored in the address part 3-3*b*, and decoded by the address decoder 3-1, whereby an address A1 of the ROM 3-2 is designated. Consequently, a data J1 corresponding to A1 is obtained from the decoder 3-4, and the data of a next address A3 is delivered from the part 3-3*b* to the decoder 3-1.

Figure 2:
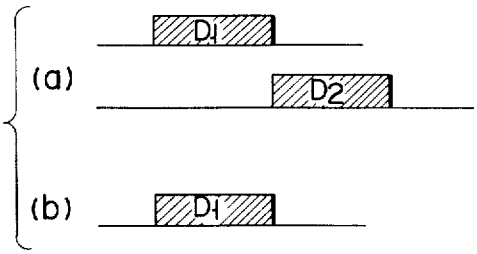
FIG. 2 is a timing chart for illustrating the operation of the circuit of FIG. 1.

Meanwhile, the code data converted by the key encoder 2 is supplied to a temporary storage register 5 through a gate circuit 4. The temporary storage register 5 has a memory capacity of 1 digit or 4 bits. Numeral 6 denotes a maximum level data generating portion which stores two code data in BCD codes corresponding to the maximum power level "9" and "99" as initial values. The maximum level data generating portion 6 selects the maximum power level "9" in the series "0" to "9" when the series selecting signal supplied through a terminal 7 is at a level "H," while it selects the maximum power level "99" in the series "0" to "99" when the series selecting signal is at a level "L." When a specified instruction data is supplied from the instruction data generating portion 3, the maximum level data generating portion 6 supplies a code data corresponding to the maximum power level in the selected series to a setting register 9 through a gate circuit 8. The setting register 9 has a memory capacity of 2 digits (D1 and D2) or 8 bits. The contents of the setting register 9 are supplied to an external circuit for setting the power level, the power level being set corresponding to such contents. The series selecting signal supplied to the terminal 7 is supplied also to a data transfer signal generating portion 10. The data transfer signal generating portion 10 supplies data transfer signals D1 and D2 to the gate circuit 8 with such timing as shown in FIG. 2(*a*) and 2(*b*) in accordance with the supplied series selecting signal and the specified instruction data from the instruction data generating portion 3. FIG. 2(*a*) shows the timing of generating the data transfer signal when the series selecting signal is at the level "H," that is, the power level series is "0" to "99," while 2(*b*) shows the timing when the selecting signal is at the level "L," that is, the power level series is "0" to "9." Namely, the gate circuit 8 transfers the code data stored in the maximum level data generating portion 6 to the setting register 9 in response to the data transfer signal from the data transfer signal generating portion 10. The stored contents of the setting register 9 are transferred to a display register 11 through the gate circuits 8 and 4, while the contents of the display register 11, in return, are transferred to the setting register 9 through the gate circuits 4 and 8.

The display register 11, which has a memory capacity of 4 digits (D1 to D4) or 16 bits, stores the contents of the setting register 9 transferred through the gate circuits 8 and 4. Further, the display register 11 is connected in series with the temporary storage register 5 through the gate circuit 4, shifting its contents to the left by 4 bits with the specified instruction data supplied from the instruction data generator 3 to the gate circuit 4. Moreover, the contents of the display register 11 are to be supplied successively to a latch circuit 12 with a capacity of 4 bits, the output of which is supplied to a display unit driver 13. The display unit driver 13 encodes the contents of the display register 11 supplied through the latch circuit 12, thereby producing a display signal. The display signal is supplied to the display unit 14, where an optional power level is displayed. Also, the contents of the display register 11 are supplied successively to a zero-suppression circuit 15 by 4 bits or 1 digit through the gate circuit 4. The zero-suppression circuit 15 detects spare zeroes stored in each digit of the display register 11, and supplies a zero suppression signal to the display unit driver 13 synchronously with such digit. That is, the display unit 14 supplied with the output signal of the display unit driver 13 suppresses the display of any spare zeroes except in the digits D3 and D4. The gate circuits 4 and 8 are supplied with the instruction data from the instruction data generating portion 3, whereby the data transfer between the key encoder 2, temporary storage register 5, display register 11, zero-suppression circuit 15, and the setting register 9 may be controlled.

Figure 3A:
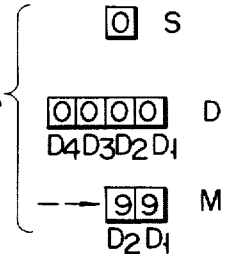
FIGS 3A to 3B, 4A to 4D, 5A to 5C, and 6A to 6D show changes of the memory contents of the temporary register, display register and setting register as shown in FIG. 1.
Figure 3B:
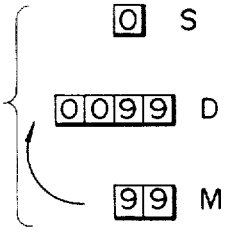

Referring now to FIGS. 3A and 3B, 4A to 4D, 5A to 5C, 6A to 6D, and 8, there will be described the operation of the circuit constructed as aforesaid. First, either the power level series "0" to "9" or "0" to "99" is selected. Here the series "0" to "99" is to be selected, by way of illustration. That is, the terminal 7 is supplied with the L-level series signal. Then the maximum level data generating portion 6 selects a code data corresponding to the maximum power level "99." Supplied with the L-level series selecting signal via the terminal 7, the data transfer signal generating portion 10 sets the data transfer signal with the timing as shown in FIG. 2(*a*). Subsequently, a predetermined address A01 of the instruction data generating portion 3 is designated by the initiative signal, and the instruction data generating portion 3 produces an instruction data J01 stored in its address A01. When the instruction data J01 is fed to the maximum level data generating portion 6 and the data transfer signal generating portion 10, the maximum level data generating portion 6 produces the code data corresponding to "99," while the data transfer signal generating portion 10 produces the data transfer signal with the timing as shown in FIG. 2(*a*). When the code data and the data transfer signal are fed to the gate circuit 8, the code data corresponding to "99" is transferred to the setting register 9. Thus, the code data "99" is stored in the setting register (M) 9 as shown in FIG. 3A. At this time, the current figures in the temporary storage register (S) 5 and the display register (D) 11 are all "0," as shown in FIG. 3A. Then the address of the instruction data generating portion 3 increases by 1 to become A1, and the instruction data generating portion 3 produces an instruction data J1 stored in the address A1. When the instruction data J1 is fed to the gate circuits 8 and 4, the contents of the setting register 9 are transferred to the digits D2 and D1 of the display register 11. Thus, the contents of the digits D4 to D1 of the display register 11, as shown in FIG. 3B, become "0," "0," "9" and "9" respectively, that is, a code data corresponding to "0099" is stored in the display register 11. The contents of the display register 11 appear at the output of the latch circuit 12 by 4 bits or 1 digit, and the output signal of the latch circuit 12 is fed to the display unit driver 13. The zero-suppression circuit 15 is supplied with the contents of the display register 11 by 4 bits via the gate circuit 4. Thereupon, the zero-suppression circuit 15 checks the digits of the display register 11 in the order of D4, D1, D2 and D3 to see if the contents of these digits are "0." If a "0" is detected, then the circuit 15 produces a zero-suppression signal for the display unit driver 13 synchronously with the digit concerned. Consequently, the display unit driver 13 drives the digits D1 and D2 of the display unit 14 to which the zero-suppression signal from the zero-suppression circuit is not applied. Thereafter, the display unit 14 displays the maximum power level "99." That is, before an optional power level is set at the ten-key board 1, the maximum power level in the series selected by the series selecting signal fed to the terminal 7 is displayed on the display unit 14, and a code data corresponding to the maximum power level is fed as a set data from the setting register 9 to the external circuit.

Figure 4A:
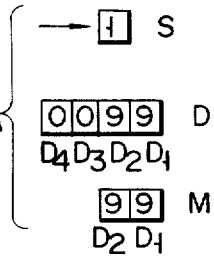
Figure 4B:
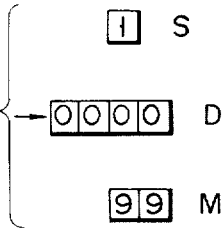

Subsequently, an optional power level, e.g. "1," is set at the ten-key board. When an output signal of the ten-key board 1 corresponding to "1" is fed to the key encoder 2, the key encoder 2 produces a code data in BCD codes corresponding to "1" and an address data for designating an address A2 of the instruction data generating portion 3. Supplied with the address data, the instruction data generating portion 3 produces an instruction data J2 stored in the address A2. When the instruction data J2 is fed to the gate circuit 4, the code data corresponding to "1" from the key encoder 2 is transferred to the temporary storage register 5. Consequently, the temporary storage register 5 stores the code data corresponding to "1," as shown in FIG. 4A. Then the address of the instruction data generating portion 3 increases by 1 to become A3, and the instruction data generating portion 3 produces an instruction data J3 stored in the address A3. When the instruction data J3 is fed to the gate circuit 4, the contents of the display register 11 are cleared to become "000," as shown in FIG. 4B. Further, the address of the instruction data generating portion 3 increases to become A4, and the instruction data generating portion 3 produces an instruction data J4 stored in the addresss A4.

Figure 4C:
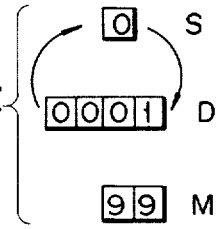
Figure 4D:
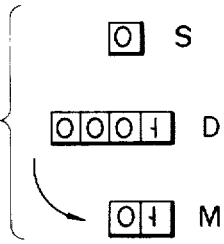

When the instruction data J4 is fed to the gate circuit 4, the contents of the display register 11 is shifted to the left by 4 bits. Then the content of the digit D4 of the display register 11 is transferred to the temporary storage register 5, the content of which is transferred to the digit D1 of the display register 11. In consequence, the content of the temporary storage register 5 becomes "0," while the contents of the display register 11 become "0001," as shown in FIG. 4C. Then the address increases to be A5, and the instruction data generating portion 3 produces an instruction data J5 stored in the address A5. When the instruction data J5 is fed to the gate circuits 4 and 8, the contents of the digits D1 and D2 of the display register 11 are transferred to the setting register 9. Consequently, as shown in FIG. 4D, the contents of the setting register 9 become "01." Thereafter, the display unit 14 displays a power level "01," while the setting register 9 stores a code data corresponding to the power level "01."

Figure 5A:
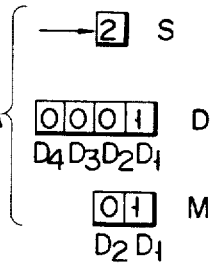
Figure 5B:
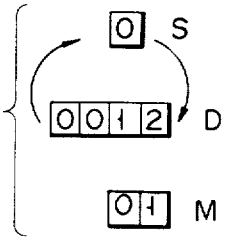
Figure 5C:
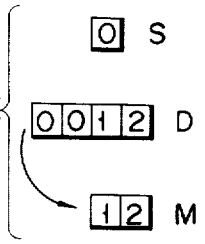

Subsequently, an optional power level "2" is set at the ten-key board 1. That is, there will be described a case where a power level "12" is set together with the "1." Supplied with an output signal corresponding to "2," the key encoder 2 produces a code data in BCD codes corresponding to "2" and an address Am of the instruction data generating portion 3. Supplied with the address data, the instruction data generating portion 3 produces an instruction data Jm stored in the address Am. When the instruction data Jm is fed to the gate circuit 4, the code data corresponding to "2" from the key encoder 2 is transferred to the temporary storage register 5. Consequently, the temporary storage register 5 stores the code data corresponding to "2", as shown in FIG. 5A. Then the address of the instruction data generating portion 3 increases to become Am+1, and the instruction data generating portion 3 produces an instruction data Jm+1 stored in the address Am+1. When the instruction data Jm+1 is fed to the gate circuit 4, the contents of the display register 11 are shifted to the left by 4 bits. The content of the digit D4 of the display register 11 is transferred to the temporary storage register 5, while the content of the temporary storage register 5 is transferred to the digit D1 of the display register 11. As a result, the content of the temporary storage register 5 becomes "0," and the contents of the display register 11 become "0012." Then the address increases to be Am+2, and the instruction data generating portion 3 produces an instruction data Jm+2 stored in the address Am+2. When the instruction data Jm+2 is fed to the gate circuits 4 and 8, the contents of the digits D1 and D2 of the display register 11 are transferred to the setting register 9. In consequence, the contents of the setting register 9 become "12," as shown in FIG. 5C. Thereafter, the display unit 14 displays a power level "12," while the setting register 9 stores a code data corresponding to the power level "12."

Figure 6A:
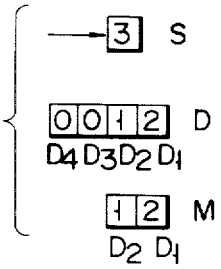

Subsequently, "3" is set at the ten-key board 1. That is, there will be described a case where the set power level exceeds the maximum power level "99." After the power level is set, the key encoder 2 produces a code data corresponding to "3" and an address data for designating an address Al of the instruction data generating portion 3. Supplied with the address data, the instruction data generating portion 3 produces an instruction data Jl stored in the address Al. When the instruction data Jl is fed to the gate circuit 4, the code data corresponding to "3" from the key encoder is transferred to the temporary storage register 5. Consequently, the temporary storage register stores the code data corresponding to "3," as shown in FIG. 6A.

Figure 6B:
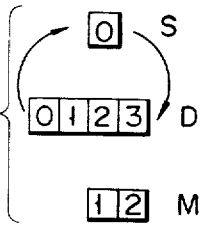
Figure 6C:
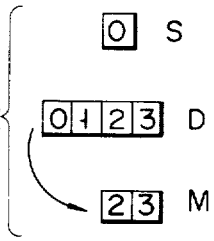
Figure 6D:
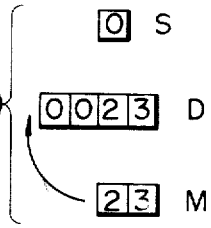

Then the address increases to become Al+1, and the instruction data generating portion 3 produces an instruction data Jl+1 stored in the address Al+1. When the instruction data Jl+1 is fed to the gate circuit 4, the contents of the display register 11 are shifted to the left by 4 bits. The content of the digit D4 of the display register 11 is transferred to the temporary storage register 5, the content of which is transferred to the digit D1 of the display register 11. Consequently, the display register 11 stores a code data "0123," as shown in FIG. 6B. Then the address increases to become Al+2, and the instruction data generating portion 3 produces an instruction data Jl+2 stored in the address Al+2. When the instruction data Jl+2 is fed to the gate circuits 4 and 8, the contents of the digits D1 and D2 of the display register 11 are transferred to the setting register 9. In consequence, the setting register 9 stores a code data "23," as shown in FIG. 6C. Thereafter, the address increases to become Al+3, and the instruction data generating portion 3 produces an instruction data Jl+3 stored in the address Al+3. When the instruction data Jl+3 is fed to the gate circuits 4 and 8, the contents of the setting register 9 are transferred to the digits D1 and D2 of the display register 11. Further, a code data corresponding to "00" is transferred to the digits D3 and D4 of the display register 11. As a result, "0023" is stored in the display register 11, as shown in FIG. 6D. Thereafter, the display unit 14 displays a power level "23," while the setting register 9 stores a code data corresponding to the power level "23."

Although there has been described cases where power levels in the series "0" to "99" are set and displayed with the L-level series selecting signal supplied to the terminal 7, power levels in the series "0" to "9" may also be managed by feeding the H-level series selecting signal to the terminal 7. That is, when the H-level series selecting signal is applied to the terminal 7, the maximum level data generating portion 6 selects a code data corresponding to the maximum power level "9," while the data transfer signal generating portion 10 sets the data transfer signal as shown in FIG. 2(*b*). Thereafter, power levels are set and displayed in the same manner as the setting of the power levels in the series "0" to "99."

Referring now to FIGS. 3A, 3B, 4A to 4D, and 8, there will be described in detail the construction and operation of the gate circuits as in FIG. 1. First, when the initiative signal is fed to the instruction data generating portion 3, a data J0 is produced from the instruction data generating portion 3, and is supplied to an AND gate 21, along with a data corresponding to the maximum level "99" from a data generator 6*a*. Passed through the AND gate 21, the maximum level data "99" is fed to the setting register (M) 9 via an OR gate 22, as shown in FIG. 3A. At this stage, the registers 5 and 11 (S and D) are both cleared.

Produced from the instruction data generating portion 3, thereafter, a data J1 is supplied to a NOR gate 23 and an AND gate 24. As a result, the output of the NOR gate 23 becomes "0," the AND gate 24 opens, and a data "99" in the setting register 9 is fed to the display register 11 via the AND gate 24 and an OR gate 25. Circulating via the OR gate 22, the contents of the setting register 9 remain as they are, as shown in FIG. 3B.

Subsequently, an instruction date J2 is produced from the instruction data generating portion, and supplied to an AND gate 26 along with a ten-key data from the key encoder 2. Consequently, the AND gate 26 opens, and a ten-key data "1" is fed to the temporary storage register 5 via an OR gate 27. The data "1" fed to the temporary storage register 5 is circulated through an inverter 28, NOR gate 29, and the OR gate 27. The contents of the display register 11 are also circulated through an inverter 30, NOR gate 23, and the OR gate 25.

Then, an instruction data J3 is produced from the instruction data generating portion 3, and supplied to the NOR gate 23. When the output of the display register 11 is "1," the output of the inverter 30 becomes "0" and the data J1 is also "0," so that the output of the NOR gate 23 becomes "0," which is applied to the input terminal of the display register 11 via the OR gate 25. When the output of the display register 11 is "0," however, the output of the inverter 30 becomes "1" while the output of the NOR gate 23 remains "0," and "0" is again applied to the input terminal of the display register 11 through the OR gate 25. After all, "0" is always fed to the input terminal of the display register 11 without regard to the contents thereof, which are cleared as shown in FIG. 4B. The contents of the display register 11 may be maintained only when the instruction data J1 or J3 is "0."

Subsequently, an instruction data J4 is produced, and fed to the NOR gate 29 and AND gates 31 and 32. As a result, the AND gates 31 and 32 open, and the output of the display register 11 is fed to the temporary storage register 5 via the AND gate 31 and OR gate 27. The output "1" of the temporary storage register 5 is supplied to the display register 11 through the AND gate 32 and OR gate 25, and shifted by 16 bits, and thus the data "1" is stored in the bottom digit of the display register 11 just as shown in FIG. 4C.

Subsequently, an instruction data J5 is produced, and fed to an AND gate 33 to open it. Consequently, the contents of the display register 11 are fed to the setting register 9 through the AND gate 33 and OR gate 22. Since the instruction data J1 is then "0," the output of the setting register 9 is prohibited by the AND gate 24, and finally the data of the display register 11 is transferred to the setting register 9, as shown in FIG. 4D.

According to this invention, as described above, the current numerical data stored in the display register may be automatically cleared when the power level setting function key is operated and a power level is fed from the ten-key board and set. Thus, there may be provided a power level setting/display circuit for a microwave oven which may effectively be used especially in setting 1-digit power level.

What we claim is:

1. A power level setting/display circuit for a microwave oven comprising a register for temporarily storing a power level command signal, a display register, means for clearing all the contents of said display register when said power level command signal is stored in said temporary storage register, means for generating a series of instruction data, a setting register, means for transferring the content of said temporary register to a predetermined location of the cleared display register in response to a said generated instruction data and for transferrinng the content of said display register to said setting register in response to another said generated instruction data.

2. A power level setting/display apparatus for a microwave over comprising a function key, a ten-key keyboard for power level setting, a key encoder for encoding a key input from said keyboard, an instruction data generating portion for successively generating a series of instruction data in accordance with the output of said key encoder, a temporary storage register for temporarily storing a power level command signal fed from said keyboard, a display register for storing a power level value data to be displayed, a setting register for storing the set power level value data, and gate means (1) for clearing all the contents of said display register when said power level command signal is stored in said temporary storage register, (2) for transferring the content of said temporary storage register to a predetermined location of the cleared display register, and (3) for further transferring said transferred content to said setting register in response to an instruction data delivered from said instruction data generating portion.

3. A power level setting/display circuit according to claim 2, wherein said instruction data generating portion includes a read-only memory, an address decoder for designating one address of said read-only memory in accordance with an initiative signal, a register to store a data formed of an instruction part and an address part read from said one address, a decoder for receiving the instruction part data to decode the instruction data, and a means for feeding the address part data to said address decoder in order to decode an address next to said one address of said read-only memory from said address part data.

4. A power level setting/display circuit according to claim 2, further comprising a data generator to generate a predetermined maximum power level data, wherein said instruction data generating portion successively generates first to sixth instruction data, and said gate means includes a first AND gate supplied with a maximum power level data from said data generator and the first instruction data, a first OR gate for feeding the output of said first AND gate to said setting register, a means for feeding back the output of said setting register to the input side of said first OR gate, a second AND gate supplied with the output of said setting register and the second instruction data, a second OR gate for feeding the output of said second AND gate to said display register, a feedback loop for feeding back the output of said display register to the input side of said display register, said feedback loop including a first inverter, a first NOR gate, and said second OR gate, a third AND gate supplied with an output numerical data from said key encoder and the third instruction data, a third OR gate for feeding the output of said third AND gate to said temporary storage register, a feedback loop for feeding back the output of said temporary storage register to the input side of said temporary storage register, said feedback loop including a second inverter, a second NOR gate, and said third OR gate, a means for supplying the fourth instruction data to said first NOR gate, a fourth AND gate supplied with the fifth instruction data and the output of said display register, a means for supplying the output of said fourth AND gate to said third OR gate, a fifth AND gate supplied with the fifth instruction data and the output of said temporary storage register, a means for supplying the output of said fifth AND gate to said second OR gate, a sixth AND gate supplied with the sixth instruction data and the output of said display register, and a means for supplying the output of said sixth AND gate to said first OR gate.

* * * * *